US005782554A

United States Patent [19]

Huang

[11] Patent Number: 5,782,554

[45] Date of Patent: Jul. 21, 1998

[54] DECORATIVE LAMP ASSEMBLY

[76] Inventor: Shun-Feng Huang, No. 13, Lane 84, Na Fu Rd., Hsinchu City, Taiwan

[21] Appl. No.: 796,731

[22] Filed: Feb. 6, 1997

[51] Int. Cl.[6] ..... F21V 29/00

[52] U.S. Cl. ..... 362/294; 362/353; 362/363; 362/376

[58] Field of Search ..... 439/418, 419, 439/602, 699.2; 362/226, 294, 351, 353, 363, 376, 378

[56] References Cited

U.S. PATENT DOCUMENTS 915,595 3/1909 Hamm ..... 362/376

940,899 11/1909 Sherrer ..... 362/376

5,395,180 3/1995 Lee ..... 362/391

*Primary Examiner*—Alan Cariaso

*Attorney, Agent, or Firm*—Varndell Legal Group

[57] ABSTRACT

A decorative lamp assembly including a base, a lamp holder holding a lamp socket on the inside and a bulb in the lamp socket, a basket fastened between the lamp holder and the base by plugging to hold a lamp shade around the bulb, and a top cap covered on the lamp holder and fastened to the lamp socket by hooks to hold down an electrical wire.

4 Claims, 4 Drawing Sheets

DECORATIVE LAMP ASSEMBLY

BACKGROUND AND SUMMARY OF THE INVENTION

The present invention relates to lamp assemblies, and more particularly to a decorative lamp assembly adapted for decorating Christmas trees, houses, etc.

A lamp assembly for regular decorative light strings and Christmas tree light sets is generally comprised of a lamp holder, a lamp socket mounted within the lamp holder to hold a bulb, and two terminals (metal contat plates) mounted in the lamp socket and connected to two conductors of an electrical wire. This structure of lamp assembly is less attractive. A decorative light string or Christmas tree light set using this structure of lamp assembly can no longer attract consumers to buy by its design. Therefore, the only way to attract consumers to buy this structure of decorative light string or Christmas tree light set is to cut down the selling price.

The present invention provides a decorative lamp assembly which has an attractive design that attracts consumers to buy. According to one embodiment of the present invention, the decorative lamp assembly comprises a base, a lamp holder holding a lamp socket on the inside and a bulb in the lamp socket, a basket fastened between the lamp holder and the base by plugging to hold a lamp shade around the bulb, and a top cap covered on the lamp holder and fastened to the lamp socket by hooks to hold down an electrical wire.

DETAILED DESCRIPTION OF THE PREFERRED EMBODIMENT

Figure 1:
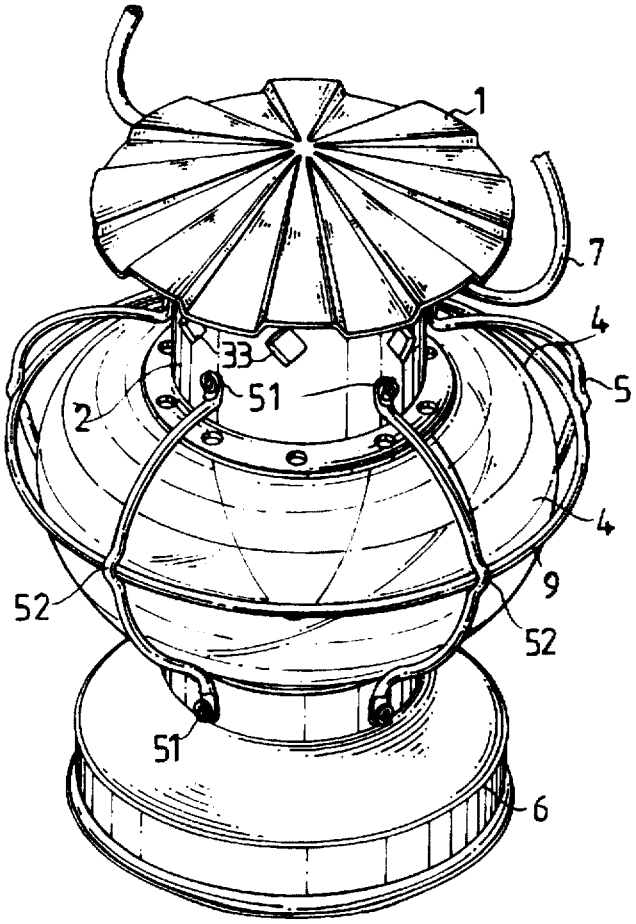
FIG. 1 is an elevational view of a decorative lamp assembly according to the present invention.
Figure 2:
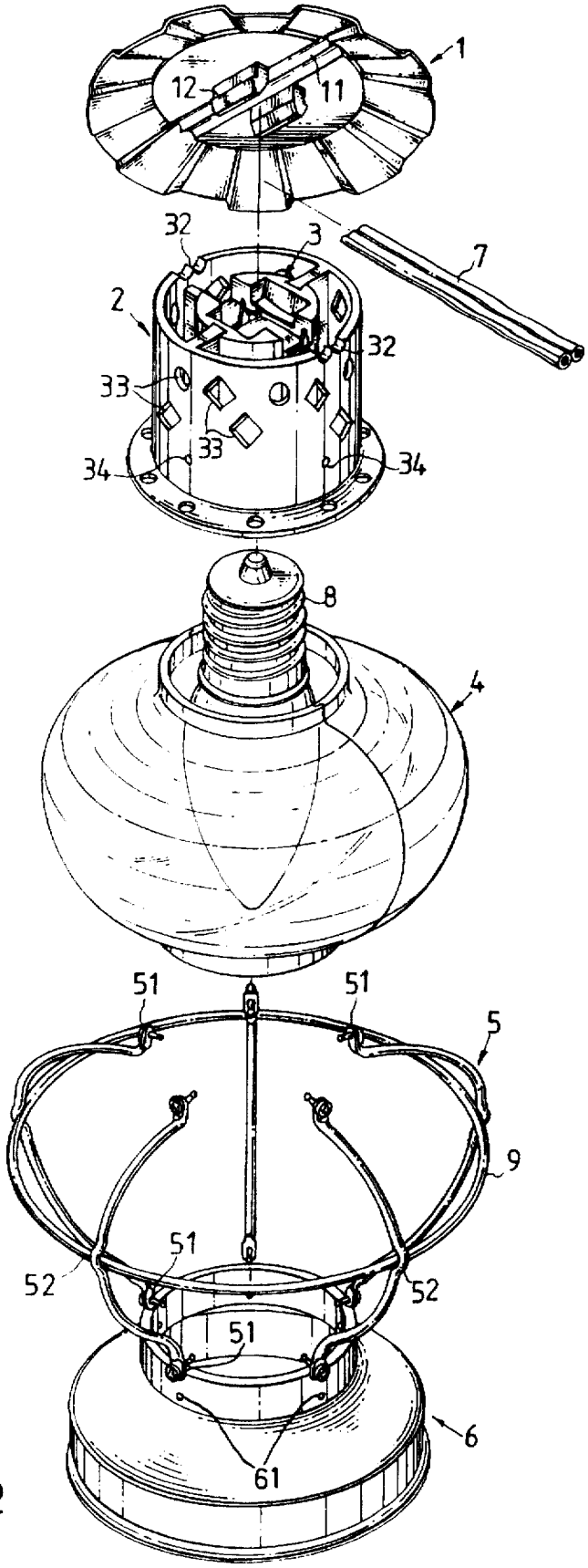
FIG. 2 is an exploded view of the decorative lamp assembly shown in FIG. 1.
Figure 3:
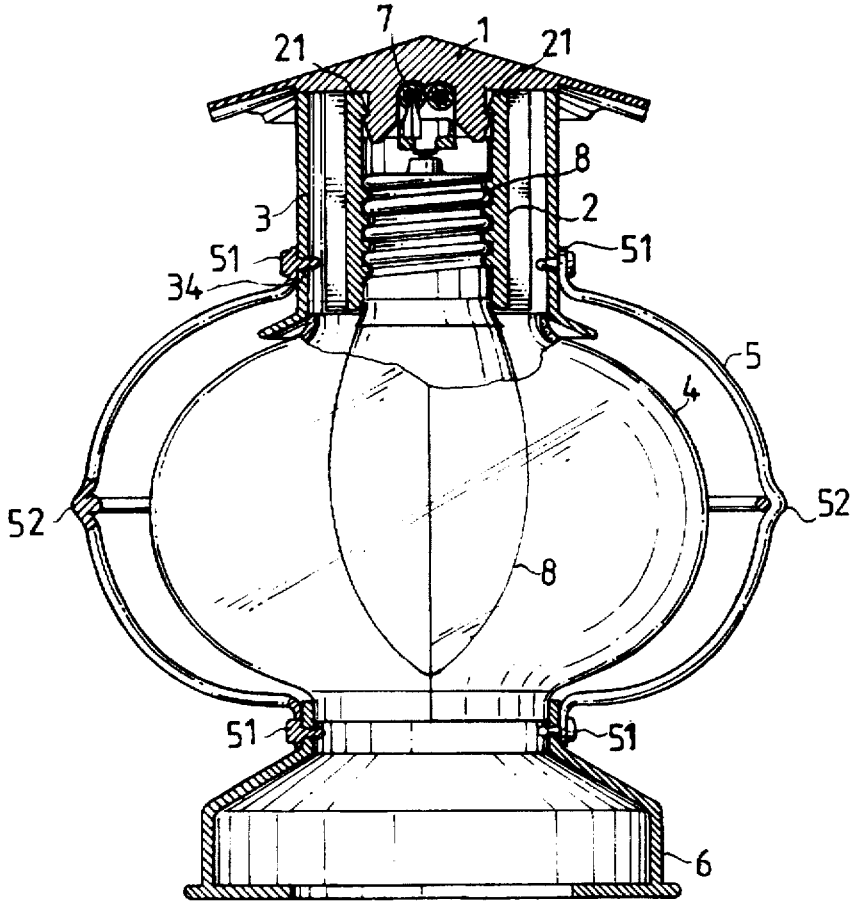
FIG. 3 is a sectional side view of the decorative lamp assembly shown in FIG. 1.
Figure 4:
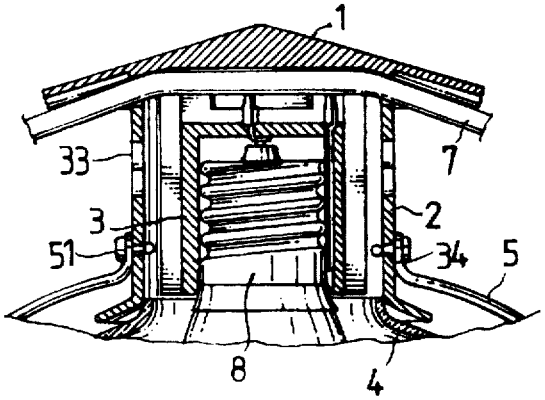
FIG. 4 is a sectional view of the upper part of the decorative lamp assembly shown in FIG. 1.
Figure 5:
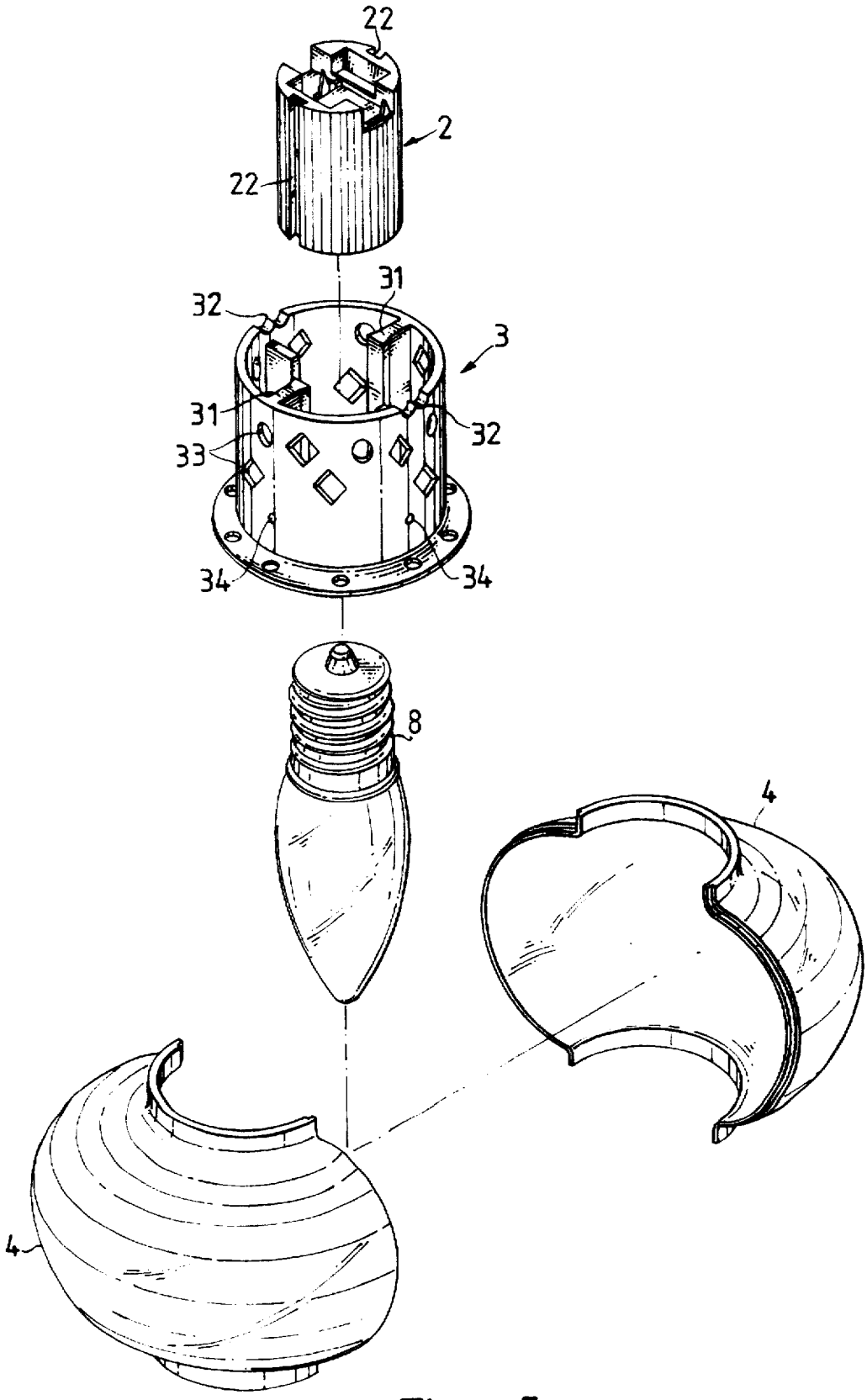
FIG. 5 is an exploded view of the lamp holder, the lamp socket, the bulb, and the lamp shade according to the present invention.

Referring to FIGS. from 1 to 5, a decorative lamp assembly in accordance with the present invention is comprised of a top cap 1, a lamp socket 2, a lamp holder 3, a lamp shade 4, a basket 5, and a base 6. The basket 5 is mounted on the base 6 to hold the lamp shade 4. The lamp holder 3 is hollow barrel mounted on the lamp shade 4 to hold the lamp socket 2 on the inside and a bulb 8 in the lamp socket 2 within the lamp shade 4. The top cap 1 is covered on the lamp holder 3, and fastened to the lamp socket 2 to hold down a two-line electrical wire 7.

The top cap 1 comprises two parallel grooves 11 at the bottom side, which receives the two-line electrical wire 7, and two downward hooks 12 fastened to the lamp socket 2.

The lamp socket 2 comprises two longitudinal mounting grooves 22 bilaterally disposed on the outside, and two hooked portions 21 bilaterally disposed on the inside at the top and adapted for hooking up with the downward hooks 12 of the top cap 1.

The lamp holder 3 comprises two pairs of wire grooves 32 symmetrically disposed at the top and adapted for receiving the two-line electrical wire 7, two longitudinal rails 31 bilaterally raised from the inside wall which are forced into engagement with the longitudinal mounting grooves 22 of the lamp socket 2 upon the insertion of the lamp socket 2 into the lamp holder 3, a plurality of air vents 33 for dissipation of heat, and a plurality of locating holes 34 for fastening to the basket 5.

The lamp shade 4 is comprised of two translucent half shells abutted together and mounted in the base 6 within the basket 5.

The base 6 is shaped like a stepped cylinder having a plurality of locating holes 51 spaced around the periphery of the upper part thereof.

The basket 5 is a hollow, circular framework made by fastening metal wires into the desired shape, having a plurality of plug ends 51 respectively plugged into the locating holes 34 of the lamp holder 3 and the locating holes 61 of the base 6, and a plurality of curved retaining portions 52 adapted for holding a loop 9.

The assembly process of the present invention is outlined hereinafter. The lamp socket 2 is mounted within the lamp holder been shown and described, it will be understood that various modifications and changes could be made thereunto without departing from the spirit and scope of the invention disclosed. For example, the lamp socket and the lamp holder may be made in integrity; the lamp shade may be integrally molded from plastic by blow casting.

I claim:

1. A decorative lamp assembly comprising:

a base having a tubular upper part and a plurality of locating holes spaced around said tubular upper part;

a lamp holder having a plurality of vent holes and a plurality of locating holes spaced around a periphery, and two pairs of wire grooves at a topmost edge;

a basket connected between said base and said lamp holder, said basket comprising a plurality of plug ends respectively fastened to the locating holes of said lamp holder and the locating holes of said base;

a lamp shade mounted within said basket;

a lamp socket disposed inside said lamp holder to hold a bulb in said lamp shade and having two hooked portions bilaterally disposed on the inside of said lamp socket; and a top cap covered on said lamp holder and secured to said lamp socket to hold down a two-line electrical wire, having two parallel wire grooves which receive said two-line electrical wire, and two downward hooks respectively hooked on the hooked portions of said lamp socket.

2. The decoration lamp assembly of claim 1 wherein said lamp socket and said lamp holder are made in integrity.

3. The decorative lamp assembly of claim 1 wherein said lamp shade is integrally molded from plastic by blow casting.

4. The decorative lamp assembly of claim 1 wherein said lamp shade is comprised of two translucent halves abutted together.

* * * * *